US005237314A

United States Patent [19]

Knapp

[11] Patent Number: 5,237,314

[45] Date of Patent: Aug. 17, 1993

[54] ADDRESSING A MATRIX DEVICE USING ELECTRO-OPTICAL SWITCHING

[75] Inventor: Alan G. Knapp, Crawley, England

[73] Assignee: U.S. Philips Corporation, New York, N.Y.

[21] Appl. No.: 780,164

[22] Filed: Oct. 21, 1991

[30] Foreign Application Priority Data

Nov. 30, 1990 [GB] United Kingdom ..... 9026040

[51] Int. Cl.[5] ..... G09G 3/36

[52] U.S. Cl. ..... 340/783; 340/784; 340/766; 359/54

[58] Field of Search ..... 340/784, 712, 707, 825.82, 340/794, 795, 796, 797, 733, 766; 341/31; 359/54; 250/251

[56] References Cited

U.S. PATENT DOCUMENTS 4,771,338 9/1988 Fujiwara ..... 359/54
4,952,031 8/1990 Tsunoda et al. ..... 359/54

FOREIGN PATENT DOCUMENTS 0117045 1/1984 European Pat. Off. .
0367152 10/1989 European Pat. Off. .
2496949 6/1982 France .
2232251 12/1990 United Kingdom .

OTHER PUBLICATIONS

C. D. Lustig, "A New Method for Addressing Flat-Panel Displays", IEEE Transactions on Electron Devices, vol. ED-29, No. 8, Aug. 1982, pp. 1334-1336.

A. Mimura et al., "High Performance Low-Temperature Poly-Si n-Channel TFT's for LCD", IEEE Transactions on Electron Devices, vol. 36, No. 2, Feb. 1989, pp. 351-359.

*Primary Examiner*—Alvin E. Oberley
*Assistant Examiner*—Kara Farnandez
*Attorney, Agent, or Firm*—Robert J. Kraus

[57] ABSTRACT

In an addressable matrix device, for example an active matrix liquid crystal display device comprising a panel (10) having a row and column array of addressable picture elements (12), in which the elements are addressed via sets of row and column address conductors (14,16) by row and column drive circuits (24,26) providing sequential outputs, at least one of the circuits (24,26) consists of a sequence generator (28,29) comprising an electro-optic switching arrangement having light sensitive means including light sensitive elements (42), e.g. photodiodes, integrated on the panel and controlling the outputs of individual output stages (38) and light emitting means (35) including a plurality of light emitting elements (36) cooperating with the light sensitive elements, the light emitting elements being selectively operable to produce a sequence of outputs from the output stages, for example in order to scan the row address conductors. The electro-optic switching arrangement requires comparatively few external connections to the panel and is of simple form so that high yields are obtained.

10 Claims, 6 Drawing Sheets

TIMING AND CONTROL CIRCUIT
VIDEO PROCESSING CIRCUIT
25
27
SEQUENCE GEN.
29
26 COL. DRIVE CIRCUIT
35
LIGHT EMIT.
35
LIGHT EMIT.
35
LIGHT EMIT.
1
2
n-1
n
32
33
BUFFER CIRCUIT
1
2
n-1
n
14
16
11
12
19
14
12
12
11
35
LIGHT EMITTER
35
LIGHT EMITTER
35
LIGHT EMITTER
1
2
m
SEQUENCE GEN.
28
16
16
14
16
11
12
19
10
24
ROW
DRIVE
CIRCUIT
31
BUFFER
CIRCUIT
20
21

ADDRESSING A MATRIX DEVICE USING ELECTRO-OPTICAL SWITCHING

BACKGROUND OF THE INVENTION

This invention relates to an addressable matrix device comprising a panel having a row and column matrix array oi addressable elements and driving means for addressing the elements via sets of row and column address conductors of the panel, the driving means comprising a row address conductor drive circuit and a column address conductor drive circuit at least one of which comprises sequence generating means having a plurality of output stages associated with respective address conductors in a group of successive address conductors.

The invention is concerned especially, but not exclusively, with matrix display devices for example comprising liquid crystal picture elements.

The invention is concerned also with addressable matrix devices generally, for example sensing devices comprising an array of addressable touch sensing or light sensing elements, or memory devices comprising a matrix array of addressable memory locations and having a memory element at each, or selected, locations.

Conventionally, matrix liquid crystal display devices comprise a row and column array of picture elements which are addressed via sets of row and column address conductors connected respectively to row and column driver circuits supplying scanning and data signals. In a typical active matrix addressed display device the row driver circuit comprises a sequence generating means in the form of a shift register circuit operable to apply a selection signal to each conductor in sequence. The column driver circuit sequentially samples a video line to store data in storage elements, e.g. capacitors, associated with the column address conductors, and includes sequence generating means comprising a shift register circuit which operates respective column switches sequentially to transfer the video data to the storage elements connected to the column conductors.

It will be appreciated that for TV displays and the like large numbers of row and column address conductors are needed to address the required number of picture elements, typically several hundreds of thousands for a medium resolution TV display. This in turn necessitates large numbers of connections between the address conductors and driver circuits if external driver circuits, for example in the form of separate chip packages, are used. This large number of connections causes to problems, not only in construction but in reliability as well.

Similar problems are experienced with other types of addressable matrix devices, for example sensing devices comprising a row and column array of sensing elements, such as touch sensitive or light sensitive elements, addressable via row and column address conductors, for example as described in GB-A-2232251 and U.S. Pat. No. 4345248, or memory devices comprising a row and column array of memory locations addressable via column and row address conductors, for example as described in EP-A-117045 or EP-A-367152. Such devices can be driven in a similar manner with the elements being addressed by a row driver circuit which selects each row of elements in turn and a column driver circuit which is operable to drive and/or sense the condition of each element in the row.

In U.S. Pat. No. 4952031 there is described a matrix liquid crystal display device which is intended to be connected with other similar display devices to form a large area display and in order to simplify interconnections between adjacent display devices an electro-optic switching arrangement is used to drive the sets of row and column address conductors. Each address conductor of one set provided on a substrate is connected to a signal bus carried on the same substrate via a respective optically-activated switch. An array of light emitting devices, one for each optically-activated switch, is provided on a separate substrate disposed adjacent the substrate carrying the set of conductors and by operating each light emitting device in turn, each of the address conductors can be connected in sequence with the signal bus by activation of its associated switch. As a separate light emitting device is required for each optically-activated switch, the number of light emitting devices required is considerable, corresponding to the number of address conductors in the set. The number of light emitting devices entailed imposes limitations on the physical lay-out of the address conductors and optically-activated switches. Furthermore, in order to energise the light emitting devices individually an equivalent number of external connections to a drive circuit, for example, a shift register circuit, are required so that similar problems to those described above result, as well as problems with ensuring that the light emitting devices are optically well coupled with the light activated switches on an individual basis without cross-talk.

SUMMARY OF THE INVENTION

It is an object of the present invention to provide an addressable matrix device in which the aforementioned problems are, at least to some extent, alleviated.

It is another object of the present invention to provide an addressable matrix device which requires only a comparatively small number of external connections.

It is another object of the present invention to provide an addressable matrix device of which the row and/or column driver circuits are of comparatively simple form.

According to one aspect of the present invention, there is provided an addressable matrix device comprising a panel having a row and column matrix array of elements, and driving means for addressing the elements via sets of row and column address conductors of the panel, the driving means comprising a row address conductor drive circuit and a column address conductor drive circuit at least one of which comprises sequence generating means having a plurality of output stages associated with respective address conductors in a group of successive address conductors, and comprising an electro-optic switching arrangement having light sensitive means comprising a plurality of light sensitive switching elements integrated on the panel and a light emitting means comprising a plurality of light emitting elements arranged to cooperate with the light sensitive switching elements, the light sensitive switching elements being operable upon illumination to produce an output from each output stage and the light emitting elements being selectively operable to illuminate particular light sensitive switching elements in predetermined order so as to produce a sequence of outputs from the output stages, which is characterized in that each output stage comprises a set of two or more light sensitive switching elements each of which elements is arranged to be illuminated by a different light emitting element, in that the number of light emitting elements is at least two greater than the number of light sensitive switching elements in the set, and in that each light emitting element illuminates light sensitive switching elements associated with more than one output stage. The provision of a plurality of light sensitive elements for each output stage, and the utilisation of each light emitting element for more than one stage offers significant advantages in that, firstly, the number of light emitting elements required for a given number of stages can be considerably reduced, and secondly, the physical layout of components is not constrained by the need to supply separate light emitting elements for each stage. Importantly, this optical addressing arrangement avoids the need to provide a considerable number of external connections corresponding to the number of address conductors.

In a preferred embodiment of the device the light emitting elements are linear and parallel and the light sensitive elements associated with each of the plurality of output stages, which preferably are connected in series, are arranged spatially to cooperate with respective, different, light emitting elements, the light sensitive elements of each output stage cooperating with a respective and different combination of the light emitting elements. The light sensitive elements are arranged for example in a series of columns, corresponding to the linear emitters, with the light sensitive elements of each set occupying different combinations of columns. To produce an output from any one of the output stages, the relevant set light sensitive elements associated with that stage are illuminated by energising a corresponding number of light emitting elements simultaneously. By appropriate selection of the combination of light emitting elements energised at any one time a particular set of light sensitive elements can be illuminated to produce an output from that stage and by successively selecting different combinations a sequence of outputs from the plurality of output stages is obtained. In this way a large number of output stages can be controlled using comparatively few light emitting and light sensitive elements. By way of example, 126 output stages can be individually addressed to provide respective outputs using just four light sensitive elements for each set in combination with only nine linear emitting elements.

The invention therefore offers considerable benefits, notably in the case of the device comprising a display device, and especially an active matrix liquid crystal display device, but also when applied to other addressable matrix devices such as those described previously.

The light sensitive elements preferably comprise thin film devices, e.g. photo-diodes, or photo-sensitive TFTs, capable of exhibiting a significant increase in current in response to illumination. Such devices can be readily integrated on the panel using technology conventionally employed in making, for example, active matrix display devices. In the case of a matrix display device, the elements and their interconnections can be fabricated directly on a part of the display panel simultaneously with other components of the panel, e.g. active devices, such as diodes or TFTs in the case of active matrix addressed display devices, and address conductors. The light emitting elements, for example, light emitting diode or electroluminescent elements, can be provided as a separate component, in the form of a package, which is mounted on, or otherwise, in close proximity the light sensitive elements on to the panel for good optical coupling. To this end, the multi-element light emitting means may be constructed in a manner similar to that of the seven segment LED display but with the light emitting elements, arranged parallel with one another.

The term "light" used herein includes non-visible parts of the spectrum, for example, infra-red.

A switching circuit controlling energisation of the light emitting elements may be positioned remotely from the package and connected thereto by leads or alternatively may be incorporated in the package itself thus reducing the number of connections necessary to the package. In either case the connections required to the package are relatively few and easily manageable.

The sequence generating means may have one or more further groups of output stages each associated with a respective address electrode in one or more further groups of successive address electrodes. In this case each group may be associated with an electro-optic switching arrangement as described with each electro-optic switching arrangement, and thus each group of output stages, being operable in turn to provide a sequence of outputs from the plurality of groups of output stages. This allows large numbers of address electrodes to be accommodated in convenient and simplified manner. This approach allows similar component parts to be used for each group. Thus within each respective group the layout of light sensitive elements and light emitting elements may be identical. Moreover each group can use identical light emitting means, the devices merely being operated in turn.

The sequence generating means may comprise part of the row drive circuit and/or part of the column drive circuit which in the case of a display device for example provide respectively row scan signals to the row address conductors sequentially and data (video) signals to the column address conductors.

In both cases, the light sensitive elements of an individual output stage may be connected so as to switch an output of the output stage from a first voltage level to a second voltage level upon being illuminated. To this end, the light sensitive elements may be connected in series with a resistance between a potential difference with the node between the light sensitive elements and the resistance being connected to an output conductor, with the resistance serving to return the output to the initial voltage level following illumination. In the case of the sequence generating means being used as part of the row drive circuit, the output stages may be connected either directly to respective row address electrodes or to a buffer stage connected between each output stage of the sequence generating means and its associated row address conductor so as to enable fast switching times regardless of the capacitance encountered with the row address conductor. When used as part of the column drive circuit, particularly in a display device, the output stages of the sequence generating means may be connected to respective stages of a sample and hold circuit which are connected to the column address electrodes.

According to another aspect of the present invention there is provided a liquid crystal display device comprising a matrix of picture elements arranged in rows and columns and comprising a row address conductor drive circuit and a column address conductor drive circuit at least one of which comprises a plurality of output stages associated with respective address conductors via electro-optical switching means which comprise light sensitive switching elements and light emitting elements arranged to cooperate with associated light sensitive switching elements to enable output stages individually, characterized in that each light emitting element is arranged to cooperate with light sensitive switching elements in several output stages, each output stage comprising at least two light sensitive switching elements associated with different light emitting elements, the total number of light emitting elements being at least two greater than the number of light sensitive switching elements in an output stage, and in that enabling of an output stage is dependent on the disposition of the light sensitive switching elements in an output stage relative to the light emitting elements.

BRIEF DESCRIPTION OF THE DRAWINGS

An addressable matrix device in accordance with the present invention, and particularly an active matrix liquid crystal display device, will now be described, by way of example, with reference to the accompanying drawing figures, in which:

It should be understood that the figures, and particularly FIG. 1, are merely schematic and are not drawn to scale. Dimensions of certain parts may have been shown exaggerated in relation to the dimensions of other parts for the sake of clarity. It should also be understood that the same reference numerals are used throughout the figures to indicate the same or similar part.

DESCRIPTION OF THE PREFERRED EMBODIMENTS

Figure 1:
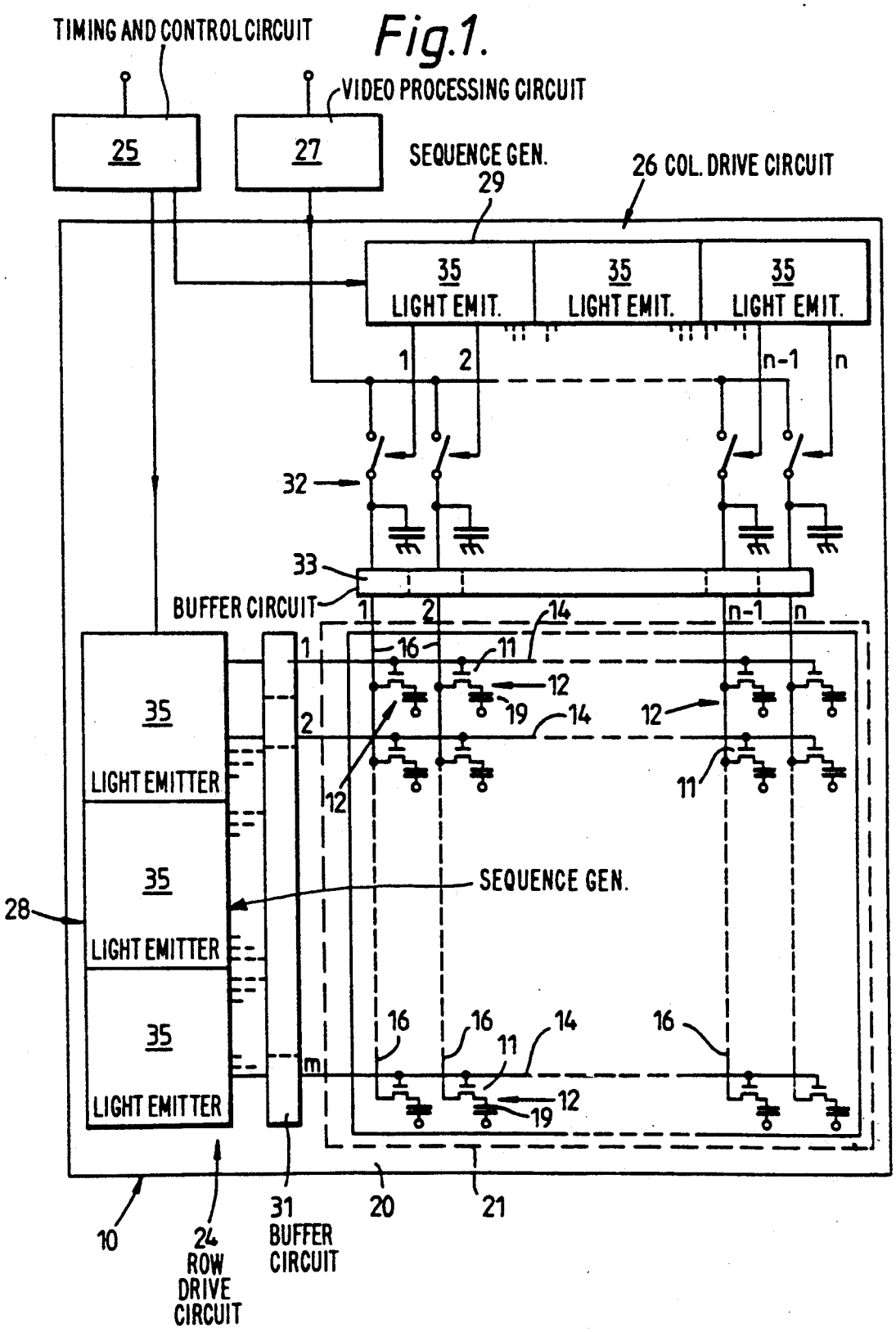
FIG. 1 is a schematic block diagram of a matrix display device according to the invention, comprising a matrix of picture elements addressed by row and column drive circuits, each of which comprises sequence generating means.

Referring to FIG. 1, the matrix liquid crystal display device, which is intended for displaying video, particularly TV, pictures, comprises an active matrix addressed liquid crystal display panel 10 having a row and column array of picture elements 12 which consists of m rows (1 to m) with n horizontally arranged picture elements 12 (1 to n) in each row. Only a few of the picture elements are shown for simplicity. In practice, the total number of picture elements ($m \times n$) in the matrix array may be several hundreds of thousands.

The picture elements 12 are each associated with a respective switching device, in this case in the form of a thin film transistor, TFT, 11, and are located adjacent the intersection of sets of row and column address conductors 14 and 16. The gate terminals of all TFTs 11 associated with picture elements in the same row are connected to a common row conductor 14 to which, in operation, scan (gating) signals are supplied. Likewise, the source terminals associated with all picture elements in the same column are connected to a common column conductor 16 to which data (video) signals are applied. The drain terminals of the TFTs are each connected to a respective transparent picture element electrode 19 forming part of, and defining, the picture element.

The row and column conductors 14 and 16, TFTs 11 and electrodes 19 are all fabricated on a transparent plate 20, for example of glass, using conventional technology. Parallel to, and spaced from, this plate is a further transparent plate 21 on which is formed a continuous transparent conductive layer constituting an electrode common to all the picture elements of the panel. The plate 21 is of smaller size than the plate 20, occupying an area slightly greater than the area of the array of picture elements 12, so that peripheral regions of the plate 20 are available to carry drive circuitry as will be described. Twisted nematic liquid crystal material is disposed between the two plates, the two plates being suitably sealed around the periphery of the plate 21. The plates are provided externally with polariser layers and internally with alignment layers in conventional manner.

In operation, the display panel is illuminated by a light source disposed on one side and light entering the panel is duly modulated according to the transmission characteristics of the picture elements 12. The liquid crystal material modulates light transmitted through the picture elements according to the voltage applied thereacross. Following standard practice the device is driven on a row at a time basis by scanning the row conductors 14 sequentially with a gating signal so as to turn on each row of TFTs in turn and applying data (video) signals corresponding to a TV line to the column conductors for each row of picture display elements in turn as appropriate and in synchronism with the gating signals so as to build up a complete display picture. The TFTs 11 of an addressed row are switched on for a period corresponding to a TV line time Tl or less during which the video information signals are transferred from the column conductors 16 to the picture elements 12 and following addressing are turned off for the remainder of the field time Tf (Tf typically being approximately equal to m.Tl) thereby isolating the picture elements from the conductors 16. The picture elements stay in the state into which they were driven until the next time they are addressed, usually in the next field period. The polarity of the signals applied to the picture elements is periodically inverted, for example after each field in conventional manner, to avoid electrochemical degradation of the LC material, although the means by which this is achieved is not shown in FIG. 1.

The row conductors 14 are supplied with gating signals in sequence by a row drive circuit 24 which is controlled by a timing and control circuit 25 to which a synchronisation signal is applied. Data signals are supplied to the column conductors 16 from a column drive circuit 26 which is supplied with video signals from a video processing circuit 27 and control signals from the timing and control circuit 25. The column drive circuit 26 samples the incoming video signal and provides a form of serial to parallel conversion appropriate to the row at a time addressing of the display panel. The row drive circuit 24 and the column drive circuit 26 each comprise sequence generating means, referenced respectively at 28 and 29, consisting of an electro-optic switching arrangement which has a plurality of output stages from which output signals are obtained in sequence and its function in this respect can be regarded as similar to that of a digital shift register circuit conventionally used in the row and column drive circuits. The number of output stages in the sequence generating means 28 and 29 correspond respectively to the numbers of row address conductors 14 and column address conductors 16 with each output stage being associated with a respective address electrode.

Each output stage of the sequence generator 28 is connected to its associated row conductor 14 via a respective stage in a buffer circuit 31 of the row drive circuit 24. In certain circumstances the buffer circuit 31 can be omitted and the output stages connected directly to the row conductors. The sequence generator 28 is operable under the control of the circuit 25 to apply scan signals to each row conductor 14, in turn.

The sequence generator 29 is operable under the control of circuit 25 similarly to produce an output signal from each of its output stages in turn. These output signals are applied to respective stages of a sample and hold circuit 32 of the column drive circuit 26 and whose outputs are connected to associated column conductors 16 via respective stages of a buffer circuit 33 of the column drive circuit. Video data, supplied by the video processing circuit 27 to the circuit 32 in serial form is converted into a parallel format by the circuit 32 for subsequent supply to the conductors 16, via the buffer circuit 33, through sequential operation of the sample and hold stages by the sequence generator 29, the sequence being repeated for each TV line to be displayed. The sample and hold circuit 32 and buffer circuit 33 are both of conventional form. For simplicity, a very basic form of sample and hold circuit is shown in FIG. 1 and it should be understood that other types of circuit can be employed as will be apparent to persons skilled in the art.

The buffer circuits 31 and 33 and the sample and hold circuit 32 are fabricated on the plate 20 of the display panel 10 outside the region occupied by the display matrix, by thin film technology, using the same processes, known per se, as for those components of the display matrix provided on that plate so that these circuits and the display matrix are integrated, and thereby avoiding the need for electrical connections to be provided separately. An example of an LC display device having such circuits integrated with the display matrix, and its fabrication, are described in the article entitled "High Performance Low-Temperature Poly-Si n-Channel TFTs for LCD" by A. Mimura et al published in IEEE Transactions on Electron Devices, February 1989, vol. 36, No. 2 at pages 351 to 359 to which reference is invited for general information.

Figure 2:
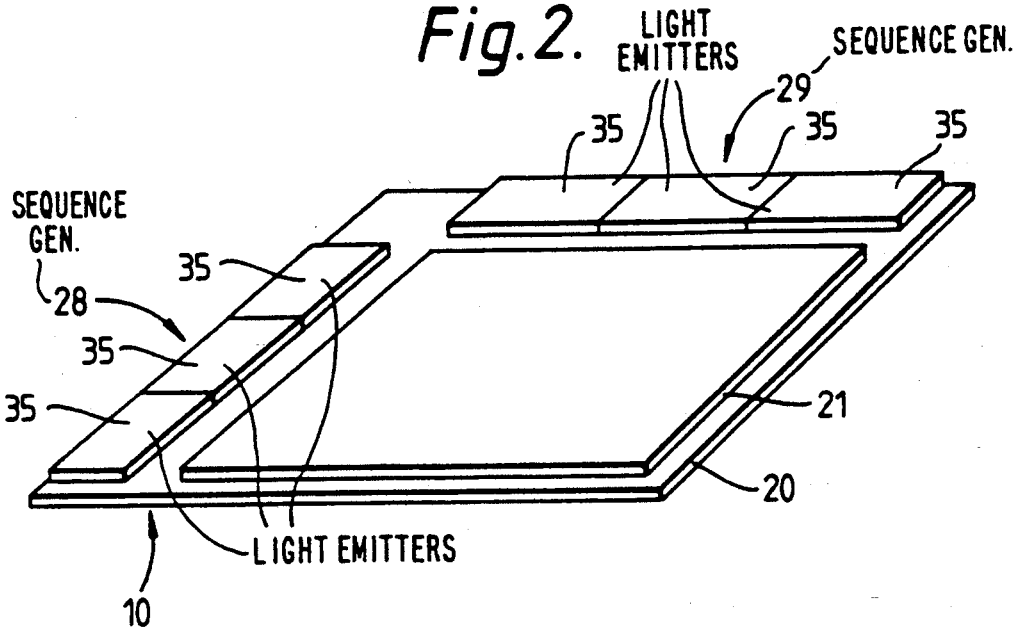
FIG. 2 is a schematic perspective view of the display device illustrating the lay-out of component parts.
Figure 3:
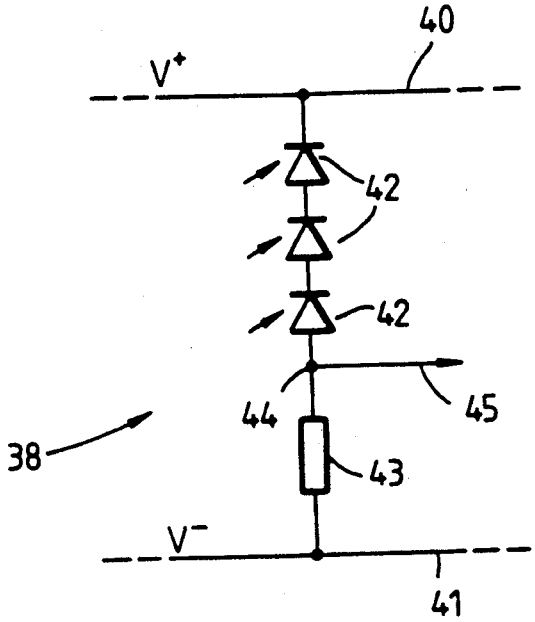
FIG. 3 is a circuit diagram of a part of the sequence generating means circuit.

The sequence generators 28 and 29 each comprise two basic components. The first, a part of whose circuit is shown in FIG. 3, comprises light sensitive means which includes light sensitive switching elements, and is integrated on the plate 20, in the same manner as the circuits 31, 32 and 33, together with the display matrix components. Its circuit elements and their interconnections are fabricated by thin film processing on the plate 20. Interconnections between the light sensitive means and the circuits 31 and 32 are formed by a thin film conductor pattern in similar manner to the sets of address conductors. The second component, a part of which is shown schematically in FIG. 4, comprises light emitting means, which includes a plurality of light emitting elements. The light emitting means is fabricated separately from the circuit elements on the plate 20 and is mounted in proximity to its associated light sensitive means, as shown in FIG. 2, such that the light emitting elements and the light sensitive elements of the components interface and cooperate with one another. Referring to FIGS. 1 and 2, each light emitting means consists of a plurality of individual and substantially identical light emitting parts 35 juxtaposed in a line with each part 35 being associated with a respective group of successive address conductors and mounted on a peripheral region of the plate 20 overlying the light sensitive means adjacent the ends of its group of conductors 14. As the light sensitive means are disposed beneath their associated light emitting means, they are not visible in FIGS. 1 and 2.

Figure 4:
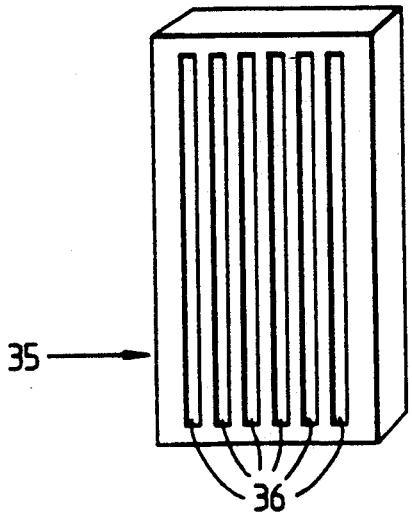
FIG. 4 is a schematic representation of another part of a sequence generating means.

With regard to the sequence generator 28, the light emitting means comprises three parts 35, each of which is associated with a respective group of m/3 row conductors 14. Referring to FIG. 4, each light emitting part 35 consists of a package containing a plurality, in this embodiment six, parallel strip-shape light emitting elements 36. The linear light emitting elements may be formed as electroluminescent strips or by LED light sources together with light conductors. Each part 35 may for example be similar in construction to a seven segment LED display device. The devices 35 are mounted on the plate 20 with their light emitting elements 36 facing the light sensitive means on the plate 20.

Figure 5:
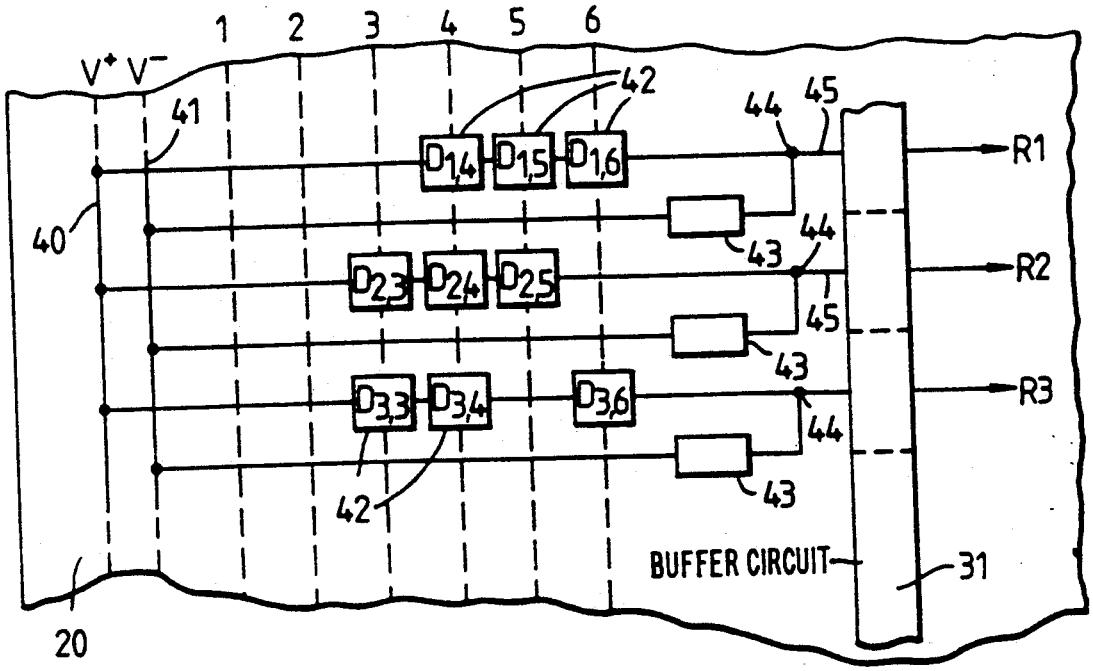
FIG. 5 illustrates schematically in plan a part of the circuit arrangement of the sequence generating means of the row drive circuit.

The light sensitive means of the sequence generator 28 consists of three identical groups of output stages, each group having m/3 output stages and cooperating with a respective light emitting part 35. The circuit of one typical output stage, 38, is illustrated in FIG. 3 and consists of $V_+$ and $V^-$ voltage rails 40 and 41, which are common to all output stages of the sequence generator, between which a set light sensitive switching elements are connected in series with a resistance 43. In this embodiment the set of light sensitive elements comprises three thin film photodiodes 42 connected in series with like polarity. The photodiodes 42 are of known form. Preferably they comprise devices formed using amorphous silicon technology, which can also be used to fabricate the TFTs 11. A conductor 45 is connected to the node 44 between the resistance 43 and photodiodes 42 and from this an output of the output stage 38 is provided. The components 40 to 45 are arranged physically on the plate 20 in the manner depicted in FIG. 5 which is a plan view of the plate 20, with the parts 35 omitted, showing the arrangement of three typical consecutive output stages associated with three successive row conductors 14, referenced R1, R2 and R3. The other output stages of the group are identical except for the lay-out of their respective photodiodes 42. The voltage rails 40 and 41 extend columnwise. Each output stage has two conductor lines which extend parallel to the row conductors 14 which contain respectively the photodiodes 42 and the resistor 43 and are interconnected at node 44. The three photodiodes of a particular output stage are spatially arranged with respect to one another and with respect to those of the other output stages in a predetermined pattern. The photodiodes of each output stage lie in a respective and different one of six available columns, labelled 1 to 6 in FIG. 5, with the particular combination of columns occupied by the set of photodiodes of any one output stage within a group of m/3 consecutive output stages being unique and different from that of the others. In FIG. 5, the photodiodes are identified by the reference Di,j where i is the output stage/row conductor number and j is the column in which it lies. Thus, the set of photodiodes of each output stage is associated with a different combination of three columns, although individual photodiodes in a number of output stages share the same column.

The spatial configuration of the sets of photodiodes in this group is repeated identically in the two other groups of m/3 consecutive output stages. Each group of m/3 output stages, and hence each of three corresponding groups of m/3 successive row conductors 14, are addressed by a respective one of the light emitting parts 35. Each part 35 is positioned such that its six linear light emitting elements 36 overlie the columns 1 to 6 respectively, with respective elements 36 of the three juxtaposed parts 35 being in alignment with each other.

The six light emitting elements 36 of a light emitting part 35 are individually energisable to emit light under the control of the circuit 25. The photodiodes operate in photo-conductive mode so that the voltage, $V_R$, at the output 45 of an output stage will be close to V− unless all photodiodes in the set concerned are illuminated, and therefore passing current, simultaneously in which case $V_R$ rises to a potential close to V+. By appropriately energising at the same time a selected combination of three light emitting elements 36 a particular set of photodiodes can be illuminated so as to cause a change in the voltage level, from approximately V− to V+, at the output 45 of the output stage concerned, and by energising in succession different combinations of three light emitting elements a sequence of output signals is obtained from the output stages 38 in turn. The duration of each output signal corresponds to the period for which the relevant light emitting elements are energised. As different combinations are energised, a voltage pulse at approximately V+ is produced from each output stage in sequence. In the example shown in FIG. 5, illumination of columns 4, 5 and 6 addresses row R1, illumination of columns 3, 4 and 5 addresses row R2, and so on.

Figure 6:
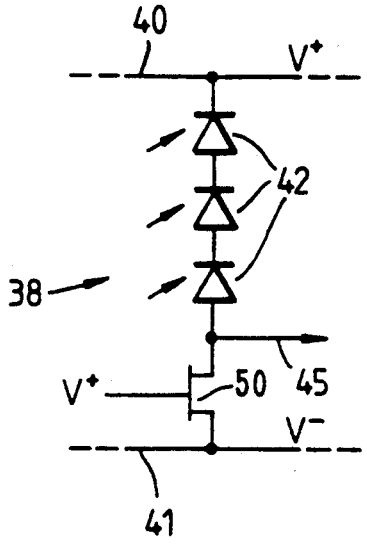
FIGS. 6*a* and 6*b* illustrate possible alternatives to the circuit part shown in FIG. 3.
Figure 6:
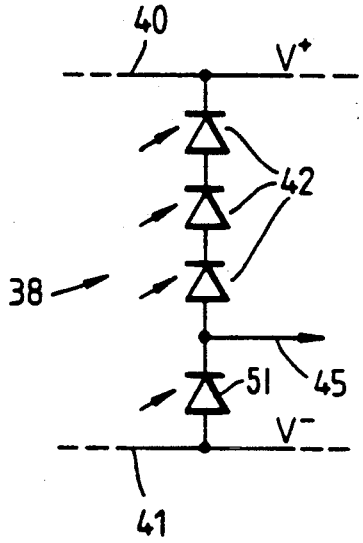

In the circuit of a typical output stage shown in FIG. 3 it is assumed that the output voltage at 44 is returned by the resistance 43 to an initial, reference level close to V− when all three photodiodes in the set are no longer simultaneously illuminated. In practice, this resistance could take the form of a TFT connected as a current source as shown at 50 in FIG. 6*a* or, alternatively, an additional photosensitive element, for example a photodiode, as shown at 51 in FIG. 6*b*. In the latter arrangement, the photosensitive elements 51 of each group of output stages are arranged in a column parallel to, but separate from, those of the photodiodes 42 and the output voltage is reset to its initial value, close to V−, by means of the energisation of an auxiliary, and dedicated, linear light emitting element provided in the part 35 parallel with the elements 36 and aligned with this separate column.

Figure 7:
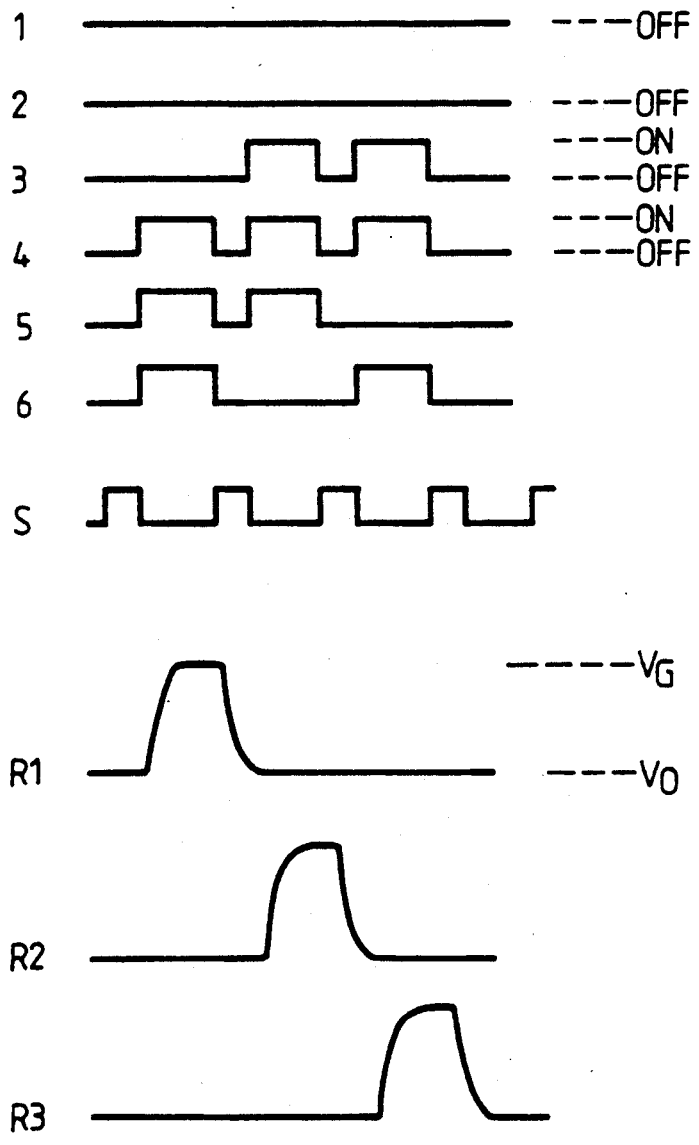
FIG. 7 illustrates various waveforms present in operation of the display device.

FIG. 7 shows the relative timing of energisation waveforms, labelled 1 to 6, applied to the six light emitting elements of a light emitting part associated with the columns 1 to 6 respectively of the photodiode array and the resulting scan signals, $V_G$, obtained on the three successive row conductors R1, R2 and R3 for the configuration illustrated in FIG. 5. The energisation waveform for the auxiliary light emitting element when using the scheme of FIG. 6*b*, using an photosensitive element in each output stage for optical resetting, is shown at S.

When all the output stages in the first group associated with the first light-emitting part 35 have been addressed, the adjacent light-emitting part 35, and thereafter the last light-emitting part 35, are operated in similar manner to address the middle and last groups of row conductors 14 respectively. After completion of each field the cycle is repeated.

In the simple example described above and illustrated in FIG. 5 in which each stage comprises a set of three photodiodes and six columns/light emitting elements are available, the number of individually addressable row conductors possible in a group is twenty so that, altogether, sixty row conductors are addressable. In practice more photodiodes and columns would be used to allow considerably greater numbers of row conductors to be addressed. The number, $N_R$, of row conductors which can be addressed in this manner is given by the expression $$N_R = \frac{M!}{K! \cdot (M-K)!}$$

where M and K respectively are the number of columns in the photodiode array and the number of photodiodes in each set. For the case in which 5 photodiodes are used in each set in 9 possible columns, the number, $N_R$, of individual addressable row conductors in one group is then 126. For the case of four photo diodes and twelve columns, then $N_R$ for each group is equal to 495.

By using comparatively high numbers of photodiodes and columns it would be possible to address all the row conductors required for a TV display using only one light emitting part 35, i.e. there need then be only one group consisting of the complete set of row conductors 14 of the display panel. However, it is preferred to divide the row conductors and output stages into groups in the aforementioned manner for simplicity of construction, bearing in mind that the light emitting part need then have a comparatively low number of light emitting elements and that the parts 35 used for each group are identical.

Of course, in tailoring the output of the sequence generator 28 to the required number of row conductors/display lines, certain possible combinations of photodiode positions, and consequently certain possible combinations of energised light emitting elements, may be unusued.

Figure 8:
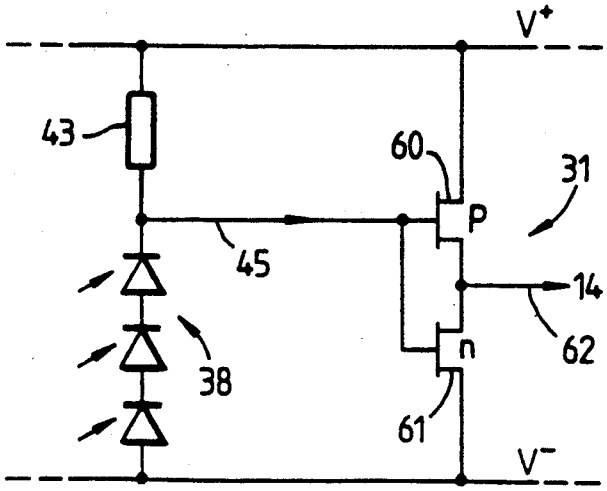
FIG. 8 illustrates the circuit configuration of a further, optional, part of the row drive circuit

As shown in FIG. 1, the output stages 38 of the sequence generator 28 are connected to the row conductors of 14 via respective stages of a buffer circuit 31. The circuit 31 may not always be necessary in which case the sequence of V+ output pulses obtained from the output stages may be supplied directly to the row conductors 14 and used directly as scan (gating) signals for addressing the picture elements. This would be possible if the row capacitance of the matrix display is small. Where the row capacitance is higher, for example above a few picofarads, a row buffer circuit is desirable in order to obtain the required switching times of a few microseconds with photodiodes whose dimensions are dictated by the availability of space at the periphery of the plate 20 and hence restricted. FIG. 8 shows an example of a suitable circuit for an individual buffer stage connected to an output stage of the light sensitive means. The output 45 of the output stage is connected to the gates of a p channel TFT 60 and an n channel TFT 61 connected in series between voltage rails at V+ and V−. An output from the buffer stage, obtained at the node between the TFTs, is connected by line 62 to the associated row conductor 14. It will be noted that in this example the buffer is inverting and consequently the disposition of the set of photodiodes and the load resistance 43 is inverted compared with FIG. 2.

It will be appreciated that the circuitry of the light sensitive means, of the sequence generator 28 formed on the panel 20 is reasonably simple and that the number of external connections needed to the panel 20 for this component is low, basically connections to V+ and V− voltage sources. Moreover, the connections required between the parts 35 and the circuit 25 are few. In order to minimise these connections, each of the three parts 35 may include a switch arrangement which, upon termination of the operation sequence of one part 35 initiates operation of the next part 35. The logic circuitry determining the energisation sequence of the light emitting elements of a part 35 may be integrated with the light emitting elements in the same package rather than being provided in the circuit 25. In this case the circuit 25 need then only provide power and timing signals thereby reducing the number of connection lines necessary between the parts 35 and the circuit 25.

Figure 9:
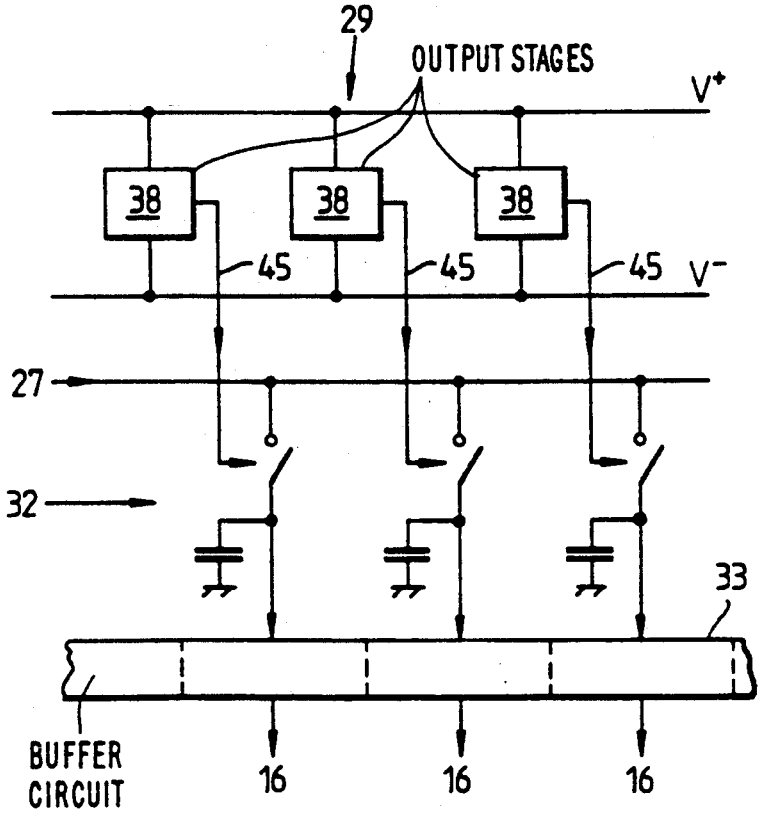
FIG. 9 illustrates a part of the column drive circuit.

The sequence generator 29 of the column drive circuit 26 is basically identical with the sequence generator 28 except that the number of output stages corresponds to the number of column conductors 16. As such, the grouping of its output stages, the number of multi-element light emitting parts 35 entailed, the number of light emitting elements 36 in each part, and the number of photodiodes in each output stage set is selected accordingly. A representative part of the sequence generator 29, comprising three typical, and successive, output stages, and the corresponding three stages of the sample and hold circuit 32 are shown schematically in FIG. 9. The output stages, referenced at 38 in FIG. 9 and shown as blocks for simplicity, each comprise the photodiode/resistance circuit as depicted in FIG. 3 or as modified according to FIGS. 6*a* or 6*b*. Of course the output stages 38 of the sequence generator 29 are arranged in a row rather than a column as in the sequence generator 28 and consequently the configuration of their circuit elements is rotated with respect to those of the generator 28 with the photodiodes being disposed in rows rather than columns as previously described. The outputs 45 of the output stages 38 are connected to electronic switches of respective sample and hold stages whereby in operation the sequence of output pulses obtained from the generator 29 actuate the sample and hold stages in turn. The sequence generator 29 is operated under the control of circuit 25 at a considerably faster rate than the generator 28 so as to sample a video information signal at n points during each TV line period, store these samples, and apply the stored voltages to the column conductors 16. In a simple scheme, a scan (gating) signal is applied by the row drive circuit 24 to the appropriate row conductor 14 during the subsequent TV line blanking period, thereby turning on the TFTs of the selected row charge up to the voltages of the associated column conductors. This simple scheme is dependent on the TFT on resistance being sufficiently low so that full charging of a picture element can occur in the line blanking period. In practice a column drive circuit comprising two sample and hold circuits would normally be used, in a known manner, to allow a longer period for picture element charging.

In an alternative embodiment, the active matrix display panel may comprise two terminal non-linear devices, such as diodes or MIMs, rather than TFTs. In this case, the column conductors 16 are omitted from the plate 20, with the row conductors being connected to the picture element electrodes 19 via respective two terminal non-linear devices, and are provided instead on the opposing plate 21 to act as counter electrodes of the picture elements. Accordingly, the sequence generator output stages of column drive circuit 26 are then integrated on the plate 21 whilst the output stages of the row drive circuit 24 remain on the plate 20.

Various modifications to the described display device are possible, as will be apparent to persons skilled in the art. The light sensitive elements 42 need not comprise photodiodes but may be any other light sensitive device whose current changes sufficiently upon being illuminated. For example thin film, photo-resistors or photosensitive TFTs fabricated, for example, using amorphous silicon, could be employed.

If desired a conventional column drive circuit could be employed with the electro-optic switching arrangement used only for driving the row electrodes.

Although the above described display devices utilise an active matrix addressed display panel, the invention is not restricted to such display devices but could be applied to simple multiplexed display panels used, for example, for datagraphic display purposes. For datagraphic, rather than TV, displays the outputs of the sequence generator 29 may be connected to their respective column electrodes 16 without a sample and hold circuit 32 or a buffer circuit 33 so as to select column electrodes directly. Moreover, the display panels may use electro-optic materials other than liquid crystal.

The invention is not limited to display devices but, as previously mentioned, can be embodied in other addressable matrix devices where a sequence of outputs is required in the addressing of an array of elements with the above described sequence generators performing a function similar to that of shift register circuits normally employed for such purposes. The sequence generators may therefore be utilised in, for instance, sensing devices comprising a panel having a row and column array of sensing elements, responsive to touch or light, which are addressed via sets of row and/or column address conductors. In such devices, a sequence generator generally similar to that described above can be used for example to provide scan signals to the row address conductors for selecting rows of elements in turn with a consequential simplification of the necessary interconnections to the panel. Similarly the invention can be embodied in memory devices comprising a row and column array of memory locations addressed via sets of row and column address conductors.

I claim:

1. An addressable matrix device comprising a panel having a row and column matrix array of elements, and driving means for addressing the elements via sets of row and column address conductors of the panel, the driving means comprising a row address conductor drive circuit and a column address conductor drive circuit at least one of which comprises sequence generating means having a plurality of output stages associated with respective address conductors in a group of successive address conductors, and comprising an electro-optic switching arrangement having light sensitive means comprising a plurality of light sensitive switching elements integrated on the panel and a light emitting means comprising a plurality of light emitting elements arranged to cooperate with the light sensitive switching elements, the light sensitive switching elements being operable upon illumination to produce an output from each output stage and the light emitting elements being selectively operable to illuminate particular light sensitive switching elements in predetermined order so as to produce a sequence of outputs from the output stages, characterized in that each output stage comprises a set of two or more light sensitive switching elements each of which elements is arranged to be illuminated by a different light emitting element, in that the number of light emitting elements is at least two greater than the number of light sensitive switching elements in the set, and in that each light emitting element illuminates light sensitive switching elements associated with more than one output stage.

2. An addressable matrix display device according to claim 1, characterized in that the two or more light sensitive switching elements are connected in series.

3. An addressable matrix device according to claim 1 or 2, characterized in that the light emitting elements are linear emitting elements arranged parallel to one another and the light sensitive switching elements of each output stage are arranged spatially to cooperate respectively with a different combination of light emitting elements.

4. An addressable matrix device according to claim 1 or 2, characterized in that the light emitting means is provided as a package mounted in proximity to the light sensitive means.

5. An addressable matrix device according to claim 4, characterized in that the light sensitive switching elements are disposed on a plate of the panel on whose surface the group of address conductors is provided, and in that the package is mounted on this plate overlying the light switching elements.

6. An addressable matrix device according to claim 1 or 2, characterized in that the sequence generating means comprises a plurality of the electro-optic switching arrangements each of which is associated with a respective one of a plurality of groups of successive address conductors, and in that the plurality of electro-optic switching arrangements are operable in turn to provide a sequence of outputs from the groups of output stages.

7. An addressable matrix device according to claim 1 or 2, characterized in that each output stage comprises a circuit arrangement containing the two or more light sensitive switching elements and having an output which is switched from a first voltage level to a second voltage level upon illumination of the two or more light sensitive switching elements.

8. An addressable matrix device according to claim 1, characterized in that in each output stage the two or more light sensitive switching elements are connected in series with a resistance element between first and second voltage lines with the output being obtained from the node between the light sensitive switching element and the resistance element.

9. An addressable matrix device according to claim 1 or 2, characterized in that the light sensitive switching elements comprise thin film devices.

10. A liquid crystal display device comprising a matrix of picture elements arranged in rows and columns and comprising a row address conductor drive circuit and a column address conductor drive circuit at least one of which comprises a plurality of output stages associated with respective address conductors via electro-optical switching means which comprise light sensitive switching elements and light emitting elements arranged to cooperate with associated light sensitive switching elements to enable output stages individually, characterized in that each light emitting element is arranged to cooperate with light sensitive switching elements in several output stages, each output stage comprising at least two light sensitive switching elements associated with different light emitting elements, the total number of light emitting elements being at least two greater than the number of light sensitive switching elements in an output stage, and in that enabling of an output stage is dependent on the disposition of the light sensitive switching elements in an output stage relative to the light emitting elements.

* * * * *